US005409136A

United States Patent [19]

Workum

[11] Patent Number: 5,409,136

[45] Date of Patent: Apr. 25, 1995

[54] SPRAYING DEVICE FOR DEFORMABLE CONTAINER ABLE TO DIVERT VERTICAL SPRAY INTO SPRAY AT AN ANGLE

[75] Inventor: Donald Workum, Kuesnacht, Switzerland

[73] Assignee: Interscents N.V., St. Maarten, Netherlands Antilles

[21] Appl. No.: 133,259

[22] Filed: Oct. 8, 1993

Related U.S. Application Data

[63] Continuation-in-part of Ser. No. 870,967, Apr. 20, 1992, abandoned.

[30] Foreign Application Priority Data

May 1, 1991 [NL] Netherlands ..... 9100746

[51] Int. Cl.[6] ..... B67B 7/00

[52] U.S. Cl. ..... 222/1; 222/148; 222/190; 222/211

[58] Field of Search ..... 222/190, 189, 211, 212, 222/207, 148, 633, 1; 239/112, 113, 114, 327, 434, 427.3, 429

[56] References Cited

U.S. PATENT DOCUMENTS

| | | | |
|---|---|---|---|
| 2,574,747 | 11/1951 | McNutt | 222/633 X |
| 3,341,130 | 9/1967 | Weber | 239/327 |
| 4,401,270 | 8/1983 | McKinney | 222/212 |
| 4,415,122 | 11/1983 | Laauwe | 239/327 |
| 4,509,661 | 4/1985 | Sugizaki et al. | 222/190 |
| 4,673,110 | 6/1987 | Workum | 222/211 |
| 4,738,398 | 4/1988 | Corsette | 239/427.3 |
| 5,110,051 | 5/1992 | Bennett | 222/211 |
| 5,156,307 | 10/1992 | Callahan et al. | 239/327 |

*Primary Examiner*—Gregory L. Huson
*Attorney, Agent, or Firm*—Foley & Lardner

[57] ABSTRACT

Spraying device for a deformable container, with a closing cap with a support to which a dip tube is fastened. The liquid coming from the dip tube upon squeezing the container is mixed with the air from the container and the mixture is led through an opening situated in the cap. The opening laterally connects to a bore which is open at one end for discharge of the mixture to the outside. An air duct ends in the bottom of the bore, situated opposite the open end, with the axis of the air duct running parallel to that of the bore. The air duct is connected to a space which is normally situated above the highest liquid level.

36 Claims, 5 Drawing Sheets

SPRAYING DEVICE FOR DEFORMABLE CONTAINER ABLE TO DIVERT VERTICAL SPRAY INTO SPRAY AT AN ANGLE

CROSS REFERENCE TO RELATED APPLICATION

This application is a continuation-in-part of Ser. No. 07/870,967, now abandoned, filed Apr. 20, 1992, by Donald Workum.

BACKGROUND OF THE INVENTION

1. Field of the Invention

The invention relates to a spraying device for a deformable container. The device comprises a closing cap for the container and supporting means directly or indirectly connected therewith to which a dip tube projecting in the container is mounted and through which, on squeezing the container, liquid will be forced into a chamber situated within the cap. In the chamber, the liquid is mixed with air flowing from the container into the chamber. The mixture is discharged from the chamber outwardly through an opening present in the cap, which is enclosed at an angle to the axis of the cap and the container. Air can flow into the container from the opening, when the container takes up its original shape again after discharge of the formed mixture.

2. Discussion of the Related Art

Such a device is known from U.S. Pat. No. 4,673,110. With this known device, when the angle of the opening in which the closing cap encloses with the axis of the cap is too large, spraying of the liquid will be adversely affected.

Thus, with increasing deflection of the mixture or the spray, the liquid drops will unite so that the size of the drops will increase. The sprayed mixture, that is, the spray, will also have a less uniform composition.

SUMMARY OF THE INVENTION

In order to obviate this difficulty and adapt the device for spraying a liquid-air-mixture in several directions, according to the invention it is provided, that an opening situated in the closing cap ends laterally in a bore made in the cap. The bore is open at one end for discharge of the formed mixture outwardly, while an air duct ends in the bottom of the bore, situated opposite the open end. The axis of the air duct extends substantially parallel to that of the bore. The air duct, on the other hand, is connected to a space in the container which is normally situated above the highest liquid level in the container.

Owing to the fact that the opening ends laterally in the bore, the result is achieved that the mixture arriving in the bore is subjected to an air flow emerging from the air duct. Being substantially square to the direction of flow of the mixture, the air flow produces the deflection of the mixture, that is, the spray, while maintaining its quality.

According to a preferred embodiment of the invention, it can be provided, that a duct section, running practically parallel to the axis of the cap and the container, connects to the section of the air duct running practically parallel to the axis of the bore. The first mentioned section extends through a substantially cylindrical part of the cap, such that the inner end of the air duct connects directly to the space in the container which is normally situated above the highest liquid level.

The air duct can then simultaneously serve for sucking air into the container when, after spraying has taken place, it is released and will take up its original shape again. Due to this action, the inflowing air will have a considerable velocity, by which a good cleaning of the narrow discharge bore is guaranteed.

There is also the possibility that a duct section running substantially parallel to the axis of the cap and the container connects to the section of the air duct running practically parallel to the axis of the bore. The first mentioned section extends far into the space which is situated within a substantially cylindrical part of the cap. The cylindrical part, near its innermost edge, is connected to a substantially radially extending part of the supporting means. In the radially extending part, one or more openings are situated for receiving air in the container following discharge of the formed mixture, when it takes up its original shape again.

Naturally, both air ducts could be applied simultaneously, but this only leads to a more complicated and thus more expensive spraying device.

Although the axis of the bore can be square to the axis of the container and the cap, according to the invention it can also be provided that the axis of the bore encloses an angle between 10° to 150° with the extension of the axis of the container and the cap. The discharged mixture or the spray can thus then be directed upward or downward, depending on the intended application of the deformable container.

Further, it will be obvious, that the features applied with the invention are also useful with other embodiments of spraying devices, as described in the specification of the US patent mentioned above.

BRIEF DESCRIPTION OF THE DRAWINGS

The invention will now be explained with reference to the embodiments, shown in the drawing, which shows a vertical section through a spraying device according to the invention. In the drawing.

DETAILED DESCRIPTION OF THE PREFERRED EMBODIMENTS

Figure 1:
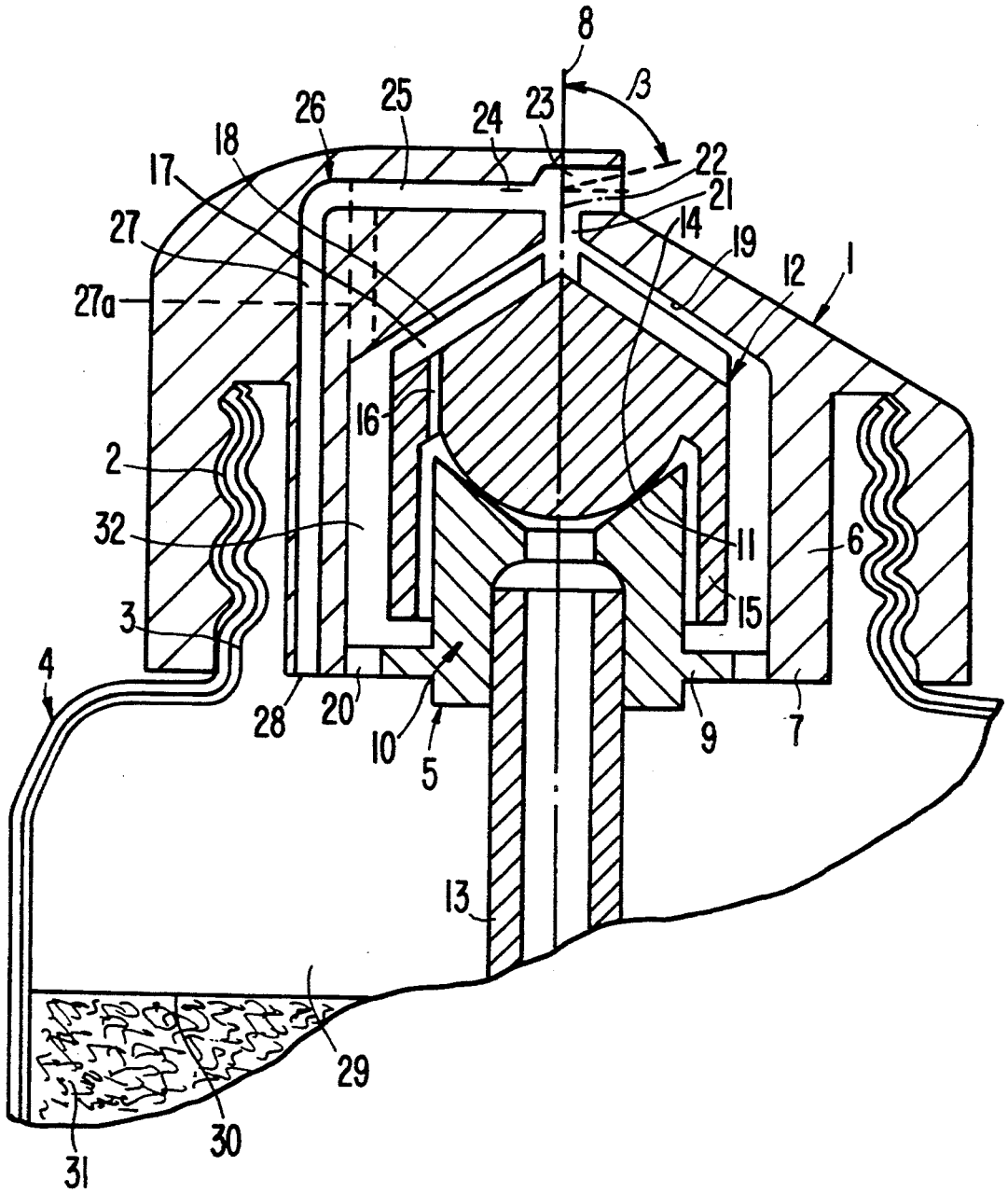
FIG. 1 depicts a cross section of a first embodiment in full lines and another possible embodiment in dashed lines.

The spraying device shown in the drawing comprises a closing cap 1, which is provided with a screw-thread 2 for applying it onto a neck 3 of a deformable container 4, of which only a small part is shown in the drawing.

A supporting means 5 is connected to an innermost edge 7 of a substantially cylindrical part 6 of the cap 1. A part 9 of the supporting means 5 running radially in relation to an axis 8 of the container 4 carries a valve support 10. The valve support 10 is provided with a valve seat 11 on which a movable valve 12 rests. Opposite to the valve seat 11, the support 10 is provided with a dip tube 13, which extends as far as near the bottom of the container 4 (not illustrated).

The valve 12 consists of a part 14 sealing in relation to the valve seat 11, and a cylindrical part 15 extending downwardly with an opening 16 in a transition between both parts. The opening 16 ends in a chamber 17, which is formed in an upper plane 18 of the valve 12. It is also possible that more than one opening 16 and chamber 17 are present.

Upon applying pressure on the container 4 by hand, a liquid 31 will be forced under the valve 12 through the dip tube 13. The valve 12 will then be lifted from its seat 11 and the upper plane 18 will come to lie against an inner plane 19 of the cap 1. The liquid will then flow through the opening 16 into the chamber 17. There the liquid will be mixed with air which is forced from the container 4 into the chamber 17 through at least one opening 20 in the radial part 9 of the supporting means 5.

The mixture thus formed will leave the chamber 17 through an opening 21, an axis 22 of which can extend in the direction of the axis 8 of the container 4. A bore 23 connects to the opening 21. The bore has an axis 24 which is practically square to the axis 22 of the opening 21.

A section 25 of an air duct 26 connects to the bore 23. The section 25 runs substantially parallel to the axis 24 of the bore 23. A further section 27 of the air duct 26 extends through the cylindrical part 6 of the cap 1. An inner end 28 of the air duct 27 ends in a space 29 of the container 4. The space is in general above a level 30 of the liquid 31 present in the container 4.

As already mentioned above, a liquid-air-mixture will be formed in the chamber 17 upon squeezing the container 4. This mixture leaves the chamber 17 through the opening 21 and arrives in the bore 23. Simultaneously, air is forced to the inner end of the bore 23 through the duct 25, so that the mixture flowing from the opening 21 in the direction of the axis 22 is deflected in the direction of the axis 24 of the bore 23.

When the pressure on the container 4 is relieved, the container 4 will take up its original shape again. Thereby, the valve 12 will be closed and air will be sucked into the container 4 through the bore 23, the air duct 26, the opening 21, along the upper plane 18 of the valve 12, through the chamber 17 and through the openings 16 and 20. This will contribute to cleaning of the naturally small openings 16, 21 and 23, so that these will not easily become jammed by any possible curing liquid.

With dashed lines it is indicated in the drawing that the section 27 of the air duct 26 can also extend as far as the space 32, which is formed between the cylindrical part 6 of the cap 1 and the cylindrical part 15 of the valve 12. The section 27 will then be replaced by the section **27*a***.

As already mentioned above, it is possible to apply both a duct 27 and a duct **27*a* in the cap 1**.

When one does not want to use the device described above for discharging a mixture, vapor or liquid particles, but for discharging foam, means known per se can be applied. For example, the mouth of the bore 23 can be enlarged and a sieve or other means can be mounted in the enlarged part. Due to the presence of the air duct 26, a better cleaning of the sieve or other means will be obtained here as well, when the container 4 resumes its original shape again after a deformation.

Figure 2:
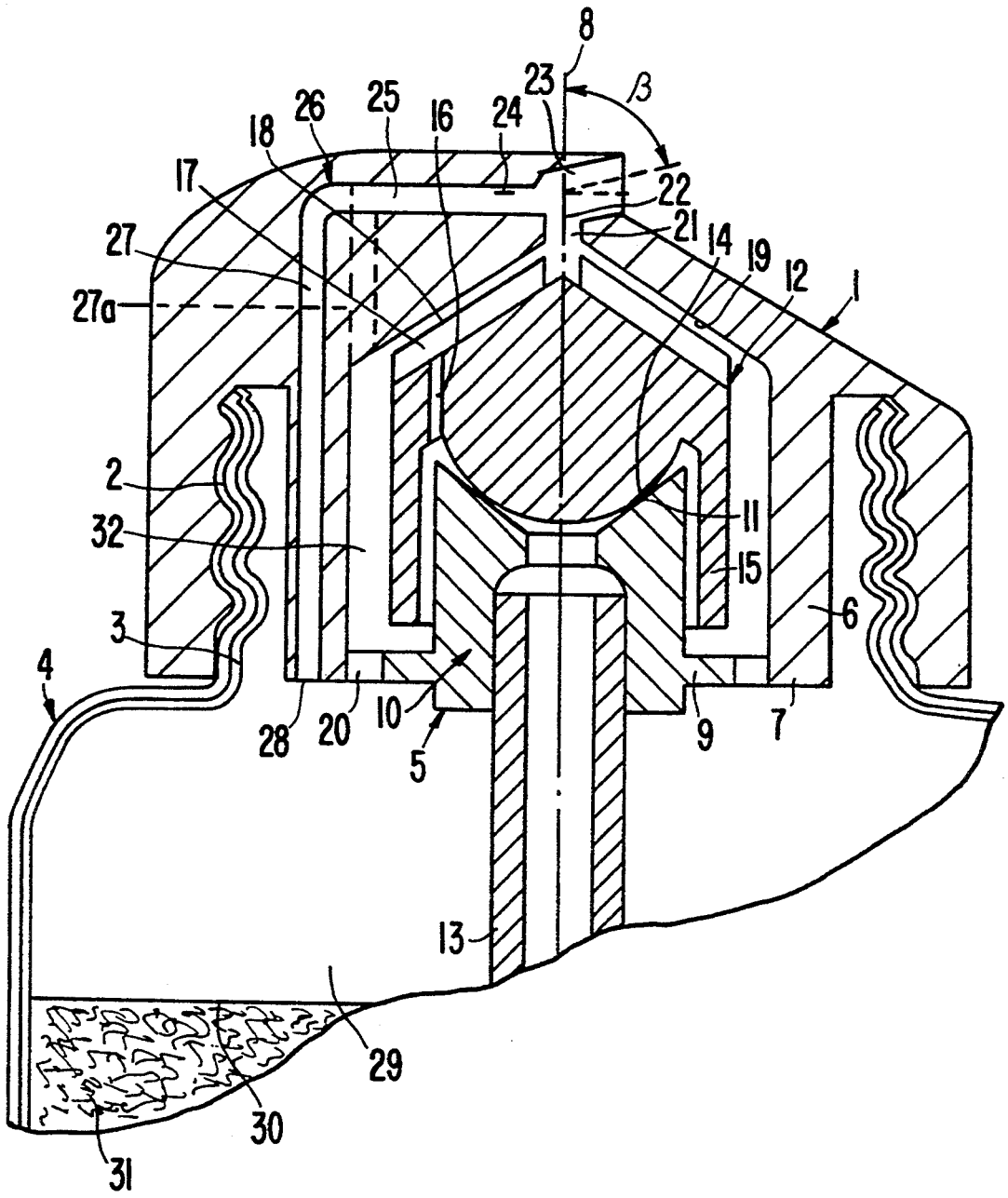
FIG. 2 depicts a cross section of a second embodiment.

Although in FIG. 1 the axis 24 of the bore 23 is square to the axis 8 of the cap 1 and the container 4, it will be obvious, as already mentioned above, that this axis 24 can also enclose an acute angle $\beta$ with the axis 8 illustrated in FIG. 2. For example, this angle $\beta$ can be between 10° and 150°, depending on the intended application of the deformable container. Therein, the air duct 25 may remain parallel to the axis 24 of the bore 23. However, for production purposes, the air duct 25 may also be at an angle, for example, equal to the angle $\beta$.

Figure 3:
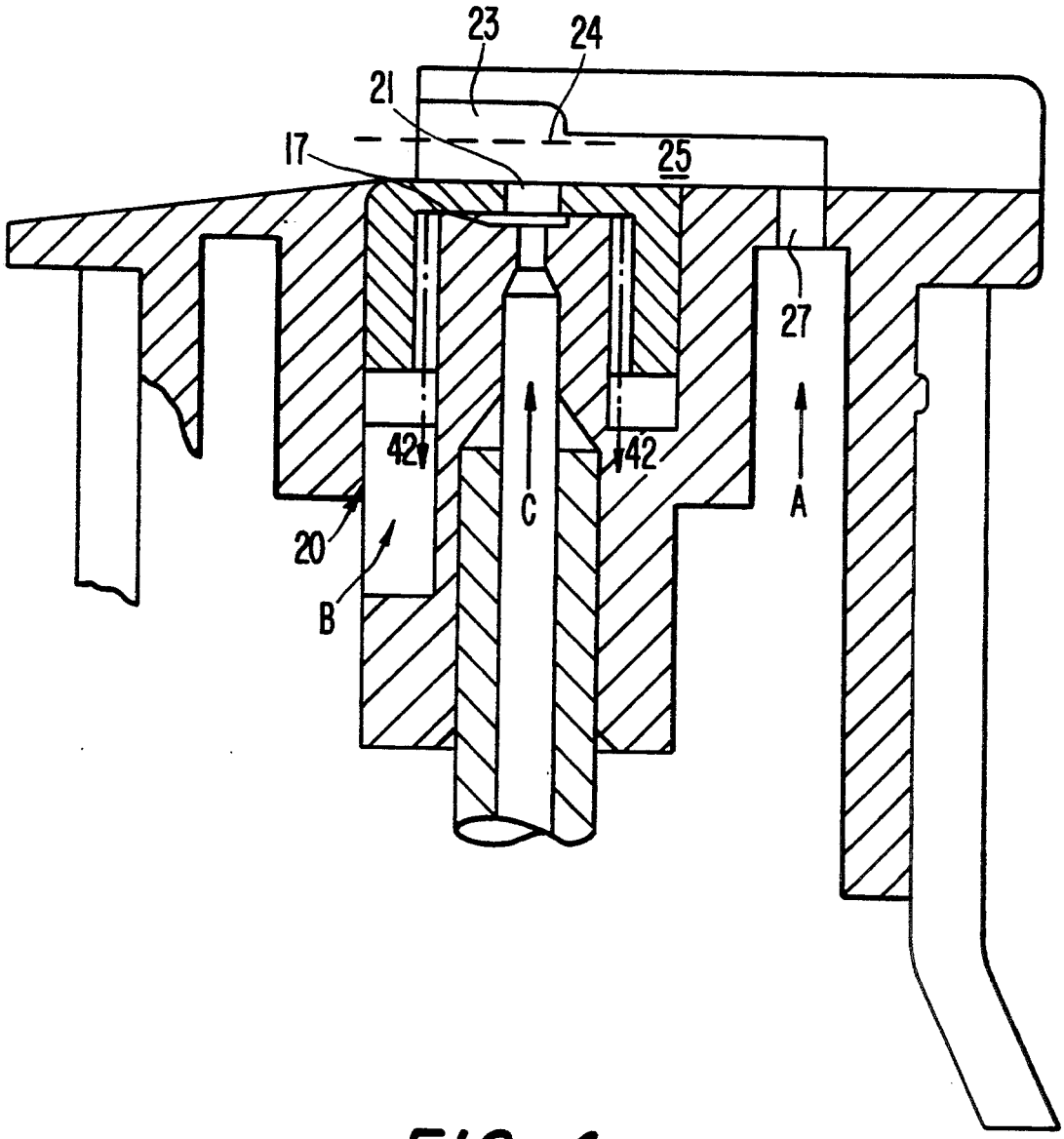
FIG. 3 depicts a cross section of a third embodiment.

FIG. 3 illustrates the most advanced commercially available vertical squeeze spray container valve, modified in accordance with the invention. Air B for breaking up the liquid C flows in through the opening 20, into mixing chamber 17 to form the liquid-air-mixture. The section 25 of air duct 26 and further duct section 27 provide extra air A to the bore 23 after the finished mixture leaves the discharge opening 21. The section 25 of the air duct 26 may have a diameter which is equal to a diameter of the further duct section 27 (FIGS. 1,2) smaller than the diameter of the further duct section 27 (FIG. 3), or larger than the diameter of the further duct section 27 (FIG. 5).

Figure 4:
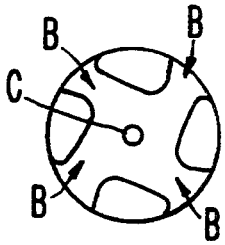
FIG. 4 depicts the mixing chamber.

FIG. 4 illustrates the mixing chamber 17, across sectional line 42 in FIG. 3. When the spray leaves the discharge opening 21, the spray is finished. If such a spray is bent from vertical to horizontal via a radius, the average particle becomes larger as the particles collide on the walls of the curve. Thus, if using a curved wall to bend the spray, particles in finished spray increase in size from, for example, 55 microns to 75 microns or more. The extra air provided to the bore after the finished spray enters the bore 23 bends and envelopes the finished spray, and thus particles do not collide. Thus, the average particle size in the spray should not be increased.

Figure 5:
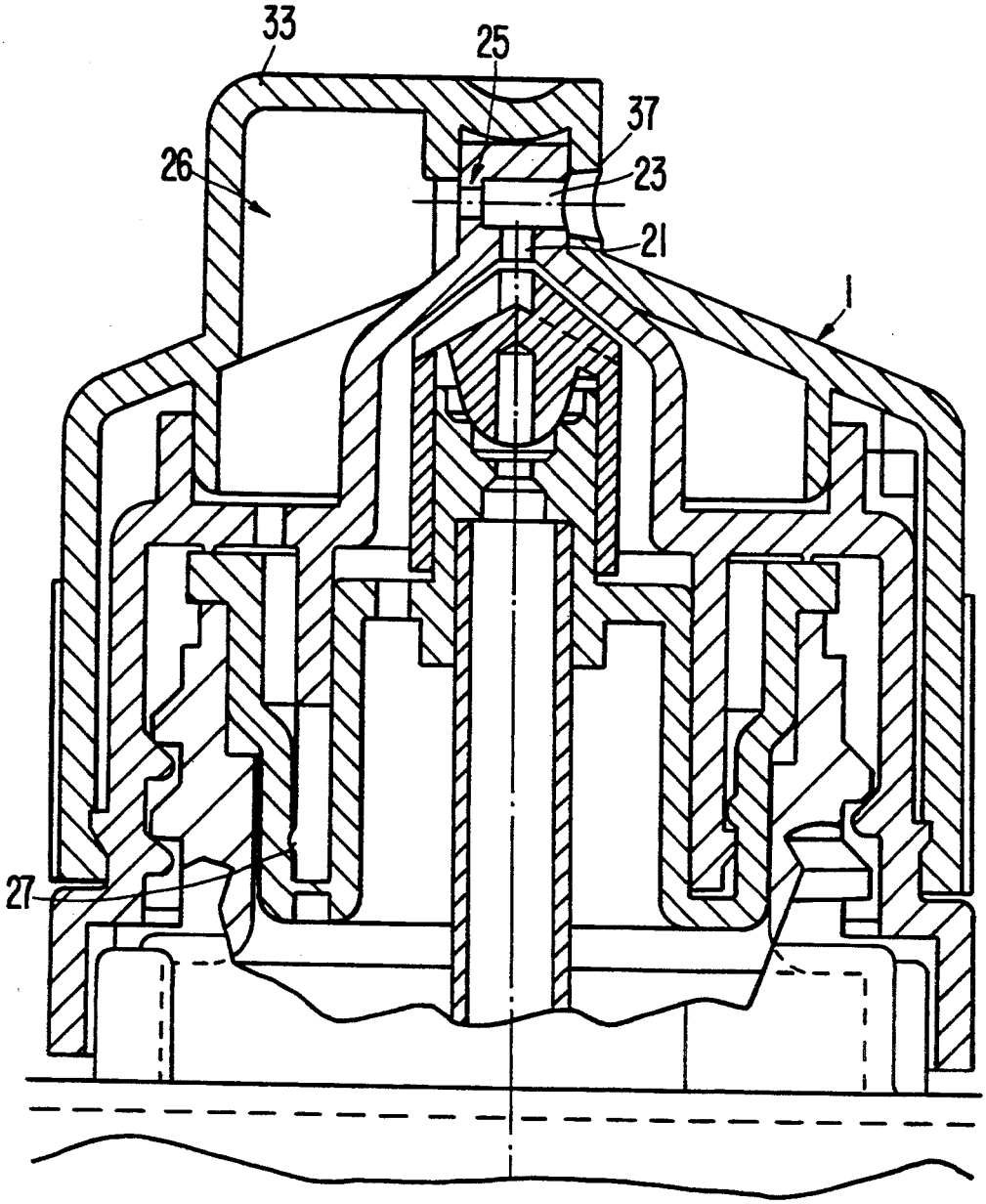
FIG. 5 depicts a cross section of a fourth embodiment.

FIG. 5 illustrates yet another embodiment. The air duct 26 includes an enlarged chamber section 33, between the first and second duct sections 25, 27. The bore 23 has an enlarged mouth 37 where the bore 23 opens to the outside of the cap 1. The air duct 26 is open to provide extra air both when the container is deformed to expel spray and when the container is resuming shape and sucking air back into the container.

Figure 6:
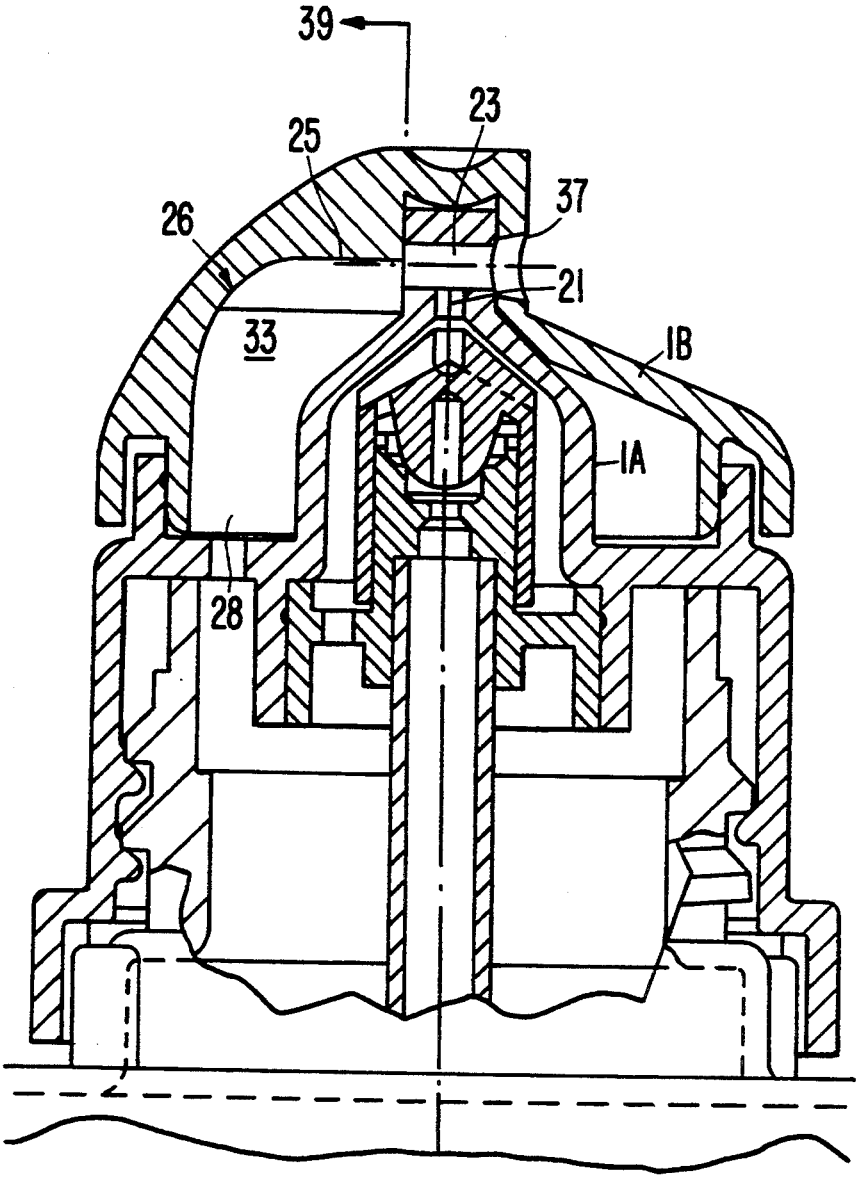
FIG. 6 depicts a cross section of a fifth embodiment.
Figure 7:
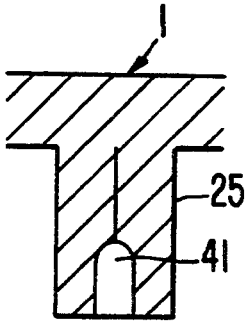
FIG. 7 depicts the first duct section of FIG. 6.

FIG. 6 illustrates a further embodiment. The enlarged chamber section 33 is included between the first and second duct sections 25, 27. An upper wall of the enlarged chamber 33 is rounded. The first duct section 25, corresponding to cross-section line 39 in FIG. 6, is shown in FIG. 7. As illustrated, the first duct section 25 includes an aperture 41 which has a narrow horizontal width. The first duct section is positioned partially over the enlarged chamber 33. With the enlarged chamber 33, the inner end of the air duct 28 or the first duct section 25 meter the quantity of air diverting the vertical spray into a spray at an angle.

The illustrated closing cap 1 is in interior and exterior sections 1A, 1B. The discharge opening 21 bore 23, and inner end 28 of the air duct are formed in interior section 1A; the duct sections 25, 27, air duct 26, and enlarged chamber 33 are formed in exterior section 1B. For shipping purposes, the exterior section 1B is rotatable in relation to the interior section 1A, so that the enlarged mouth 37 is closed off.

It will be apparent that many modifications can be made without falling outside the scope of the invention.

Thus, the invention can also be applied with a spraying device which is not provided with a shut-off valve.

In general, the application of such a valve has the advantage that, upon squeezing the container, the mixture immediately flows out, since the level of the liquid in state of rest is below the valve.

What is claimed is:

1. Spraying device for spraying a liquid contained in a deformable container capable of resuming its original shape, comprising:

(a) a closing cap adapted to be used with the container;

(b) means for supporting a valve seat and movable valve, connected to the cap;

(c) a dip tube mounted in the supporting means, for projecting into a liquid in the chamber when the cap is placed on the container;

(d) a chamber formed within the cap connected to the dip tube, in which the liquid is mixed with air to form a mixture;

(e) a bore formed within the cap connected to an outside of the cap, at an angle to an axis of the cap and container;

(f) a discharge opening formed within the cap communicating between the bore and the chamber, ending laterally in the bore, whereby the mixture may be discharged from the chamber; and (g) an air duct formed within the cap extending from and open only to the bottom of the bore, having an axis extending substantially parallel to the axis of the bore, opening to a space in the container above the highest level of liquid in the container when the cap is placed on the container.

2. A device according to claim 1 wherein the discharge opening communicates with the bore between the bottom of the bore wherein the air duct is open and a location where the bore is connected to the outside of the cap.

3. A device according to claim 1 wherein the bore has an axis which is at an angle with the extension of the axis of the container and the cap.

4. A device according to claim 3 wherein the angle is between 10° to 150°.

5. A device according to claim 4 wherein the angle is 90°.

6. A device according to claim 1, further comprising a deformable container.

7. A device according to claim 1, wherein:

(a) the cap includes a substantially cylindrical part; and (b) further comprising a duct section formed within the cap running substantially parallel to the axis of the cap and the container, connected to the air duct; the duct section extending through the substantially cylindrical part and opening to the space in the container above the liquid in the container when the cap is placed on the container.

8. A device according to claim 1, further comprising:

(a) a substantially cylindrical part on the cap, having an air space formed therein;

(b) a duct section formed in the cap substantially parallel to the axis of the cap and container, connected to the air duct;

(c) the air duct being extended into the air space;

(d) the supporting means including a radially extending part having at least one receiving opening disposed therein connected to the air space and the space in the container above the liquid in the container when the cap is placed on the container, for receiving air from the container when the container resumes its original shape after being deformed and discharging the mixture.

9. A device according to claim 1, further comprising a valve seat supported by the supporting means, and a movable valve resting thereon, the movable valve including a first part sealing to the valve seat, and a hollow cylindrical part extending from the sealing part to the chamber.

10. A device according to claim 1, wherein the bore has an axis which is at an acute angle with the extension of the axis of the container and the cap.

11. A device as in claim 1, wherein the air duct includes a first duct section and a second duct section.

12. A device as in claim 11, wherein the first duct section has a radius which is substantially equal to a radius of the second duct section.

13. A device as in claim 11, wherein the first duct section has a radius which is less than a radius of the second duct section.

14. A device as in claim 11 wherein the air duct further includes a chamber section between the first and second duct sections, and wherein the second duct section is substantially parallel to the axes of the cap and container.

15. A device as in claim 14 wherein the closing cap comprises an interior section, an exterior section rotatably connected thereto, and an enlarged mouth formed in the exterior section communicating with the bore.

16. A device as in claim 11, wherein the bore has a radius which is greater than a radius of the first duct section.

17. A device as in claim 1, wherein the bore has an enlarged mouth.

18. Spraying device for spraying a liquid contained in a deformable container capable of resuming its original shape, comprising:

(a) a closing cap adapted to be used with the container;

(b) a chamber formed within the cap in which the liquid is mixed with air to form a finished mixture;

(c) a dip tube mounted in the cap and communicating with the chamber, for projecting into a liquid in the chamber when the cap is placed on the container;

(d) a discharge opening formed within the cap communicating with the chamber, whereby the finished mixture may be discharged from the chamber;

(e) a bore formed within the cap connected to an outside of the cap, at an angle to an axis of the cap and container, the discharge opening ending laterally therein; and (f) an air duct formed within the cap extending from and open only to the bottom of the bore, opening to a space defined between the container and the cap above the highest level of liquid in the container when the cap is placed on the container, whereby extra air may be supplied to expel the finished mixture from the bore.

19. A device according to claim 18 wherein the discharge opening communicates with the bore between the bottom of the bore wherein the air duct is open and a location where the bore is connected to the outside of the cap.

20. A device as in claim 18, wherein the air duct includes a first duct section substantially parallel to the axis of the bore and a second duct section substantially parallel to the axes of the cap and the container.

21. A device as in claim 20, wherein the first duct section has a radius which is substantially equal to a radius of the second duct section.

22. A device as in claim 20, wherein the first duct section has a radius which is less than a radius of the second duct section.

23. A device as in claim 20, wherein the air duct further includes a chamber section between the first and second duct sections.

24. A device as in claim 23 wherein the closing cap comprises an interior section, an exterior section rotatably connected thereto, and an enlarged mouth formed in the exterior section communicating with the bore.

25. A device as in claim 20, wherein the bore has a radius which is greater than a radius of the first duct section.

26. A device as in claim 18, wherein the bore has an enlarged mouth.

27. A device according to claim 18 wherein the bore has an axis which is at an angle with the extension of the axis of the container and the cap.

28. A device according to claim 27 wherein the angle is between 10° to 150°.

29. A device according to claim 28 wherein the angle is 90°.

30. A device according to claim 18, further comprising a deformable container.

31. A device according to claim 18, wherein:

(a) the cap includes a substantially cylindrical part; and (b) further comprising a third duct section formed within the cap running substantially parallel to the axis of the cap and the container, connected to the air duct; the third duct section extending through the substantially cylindrical part and opening to the space in the container above the liquid in the container when the cap is placed on the container.

32. A device according to claim 18, further comprising:

(a) a substantially cylindrical part on the cap, having an air space formed therein;

(b) a third duct section formed in the cap substantially parallel to the axis of the cap and container, connected to the air duct;

(c) the air duct being extended into the air space;

(d) the supporting means including a radially extending part having at least one receiving opening disposed therein connected to the air space and the space in the container above the liquid in the container when the cap is placed on the container, for receiving air from the container when the container resumes its original shape after being deformed and discharging the mixture.

33. A device according to claim 18, further comprising a valve seat supported by the supporting means, and a movable valve resting thereon, the movable valve including a first part sealing to the valve seat, and a hollow cylindrical part extending from the sealing part to the chamber.

34. A device according to claim 18, wherein the bore has an axis which is at an acute angle with the extension of the axis of the container and the cap.

35. A method for spraying a liquid contained in a deformable container capable of resuming its original shape, comprising the steps of:

(a) deforming a container, containing a liquid, on which a cap is placed;

(b) projecting the liquid through a dip tube into a mixing chamber formed in a cap placed on the container;

(c) mixing a liquid with air in the mixing chamber formed in the cap to form a finished mixture;

(d) discharging the finished mixture from the chamber via a discharge opening into a bore formed within the cap connected to an outside of the cap, at an angle to an axis of the cap and container, the discharge opening ending laterally therein;

(e) supplying extra air to the finished mixture in the bore from an air duct formed within the cap extending from and open only to the bottom of the bore; and (f) expelling the finished mixture from the bore.

36. A method according to claim 35, further comprising the steps of:

(g) cleaning the bore by sucking air in to the container through the bore, the discharge opening, and the air duct, after the container has been deformed; and (h) allowing the container to resume its original shape.

* * * * *